US006966089B2

(12) United States Patent
Gold et al.

(10) Patent No.: US 6,966,089 B2
(45) Date of Patent: Nov. 22, 2005

(54) DEFORMABLE INFANT HEAD SUPPORT

(75) Inventors: Katherine Gold, Denver, CO (US); Lynn Rosen, Parker, CO (US)

(73) Assignee: Gold Bug, Inc., Denver, CO (US)

( * ) Notice: Subject to any disclaimer, the term of this patent is extended or adjusted under 35 U.S.C. 154(b) by 0 days.

(21) Appl. No.: 10/731,192

(22) Filed: Dec. 8, 2003

(65) Prior Publication Data

US 2005/0120484 A1 Jun. 9, 2005

(51) Int. Cl.[7] ..... A47D 15/00; A47G 9/00; A47C 31/00

(52) U.S. Cl. ..... 5/655; 297/219.12; 297/397

(58) Field of Search ..... 5/655, 636, 637, 5/632, 420, 417; 297/219.12, 397

(56) References Cited

U.S. PATENT DOCUMENTS

| | | | | |
|---|---|---|---|---|
| 3,813,148 A | | 5/1974 | Kraus | |
| 5,371,909 A | | 12/1994 | McCarty | |
| 5,383,711 A | | 1/1995 | Houghteling | |
| 5,586,351 A | * | 12/1996 | Ive | 5/655 |
| D393,772 S | | 4/1998 | Vingino | |
| 5,735,576 A | * | 4/1998 | Pepys et al. | 297/397 |
| 5,916,089 A | | 6/1999 | Ive | |
| 5,937,461 A | | 8/1999 | Dombrowski et al. | |
| 5,979,981 A | * | 11/1999 | Dunne et al. | 297/219.12 |
| 6,036,263 A | * | 3/2000 | Gold | 297/219.12 |
| 6,161,239 A | | 12/2000 | Grazel | |
| 6,321,403 B1 | | 11/2001 | Matthews | |
| 6,481,032 B2 | | 11/2002 | Milano et al. | |

* cited by examiner

*Primary Examiner*—Alexander Grosz
(74) *Attorney, Agent, or Firm*—Ellen Reilly; John E. Reilly

(57) ABSTRACT

An infant support pad, particularly for use with premature or smaller infants provides support for the head and neck of an infant including lateral movement as well as forward movement of an infant's head and is made up of a padded base layer extending along a substantial length of an infant's body, a deformable support member at one end of the base layer to provide support to an infant's head and neck, and complementary fasteners are attached to the base layer and support member to provide for adjustability of the support member around an infant's head and neck.

The fastener means that releasably attach the support member to the base layer are located in inner and outer positions, with the outer locations providing a broader U-shaped opening, and the inner locations providing a narrower U-shaped position, with terminal ends of the support member converging inwardly.

18 Claims, 2 Drawing Sheets

DEFORMABLE INFANT HEAD SUPPORT

BACKGROUND AND FIELD OF INVENTION

This invention relates to infant head and neck supports; and more particularly relates to a novel and improved self-supporting, flexible but firm, infant head and neck support.

Infant head supports are well known. All of the known devices are designed as a soft or passive support of an infant's head or neck. The infant head supports are designed to surround an infant's head with a cushion or head roll that is not permanently deformable. For instance U.S. Pat. No. 5,383,711 issued to Houghteling, discloses a head support device that supports the lateral sides of the infant's head from sudden movement or impact. Another example of infant head support is disclosed in U.S. Pat. No. 5,586,351 to Ive. This type of device provides a soft, pliable pad surrounding an infant's head.

It is therefore desirable to provide a deformable head and neck support for an infant which will not only protect the head and neck of an infant from sudden movement or impact but also retain a newborn's head and neck in a desired position and conform to all infant head sizes. Premature infants and newborns typically are placed in an infant carseat or stroller with an infant support pad inserted therein. Oftentimes, the infant will fall asleep and, since their neck muscles are not strong enough to hold up their head, the head will fall forward or to the side posing a risk of injury or suffocation to the infant.

There is therefore a need for an infant head and neck support that will retain a newborn's head and neck in a desired position while providing a flexible but firm, means of support that is conformable into different opening sizes according to the size of the infant's head.

SUMMARY OF THE INVENTION

It is therefore an object of the present invention to provide for a novel and improved head and neck support for infants.

It is another object of the present invention to provide for a novel and improved head and neck support for infants that is adjustable according to the size of the infant's head.

It is an object of the present invention to provide for a novel and improved head and neck support for premature infants that prevents lateral and forward movement of the head.

It is an object of the present invention to provide for a novel and improved head and neck support for infants that aids in retaining an infant in a reposed position.

It is another object of the present invention to provide a novel and improved infant head and neck support which can be used in an infant carseat, stroller or on a flat surface.

It is a final object of the present invention to provide for a novel and improved head support for infants that may serve as the sole means of support for an infant's head and neck.

In accordance with the present invention, there is provided an infant support pad with a padded base layer adapted to extend along a substantial length of an infant's body and deformable support means including an outer padding member in surrounding relation to an inner bendable reinforcing member at one end of the layer, the support member shaped to engage an infant's head and neck and terminating in a pair of downwardly projecting sides and convergent terminal ends. The support means is secured to the base layer and includes a bendable wire substantially centered within the padding. The padding and reinforcing member perform the dual functions of preventing lateral movement of an infant's head while providing a flexible but firm support.

The support member is adjustable and includes means for adjusting the support member, such as, a releasable fastener so that the sides and distal ends of the support member can be extended inwardly to form a protective shell around the head of an infant.

The above and other objects, advantages and features of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
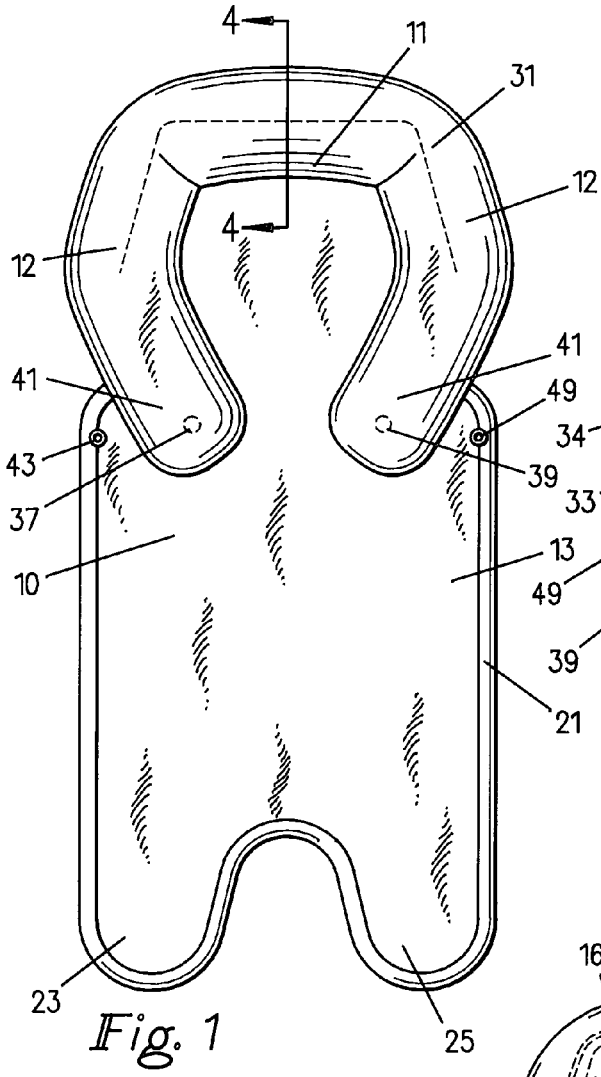
FIG. 1 is a front view of an embodiment of the present invention illustrating an infant support pad.
Figure 2:
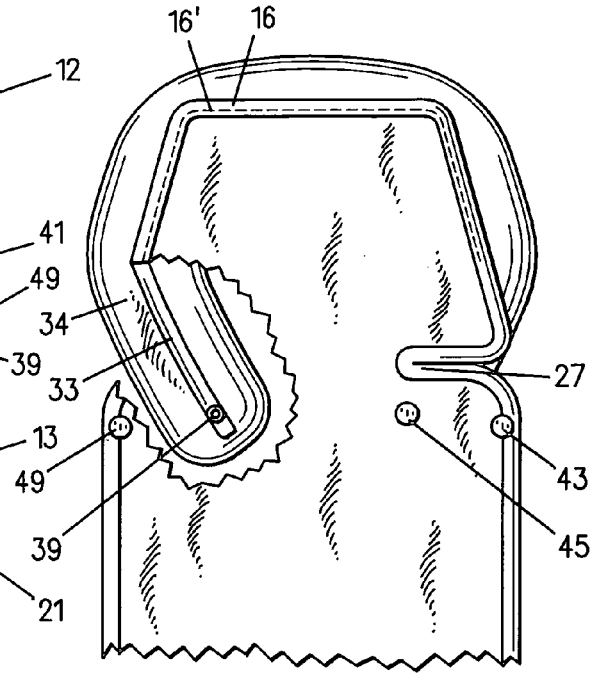
FIG. 2 is a fragmentary rear view of the embodiment of FIG. 1 with a breakaway portion illustrating a head support member.
Figure 3:
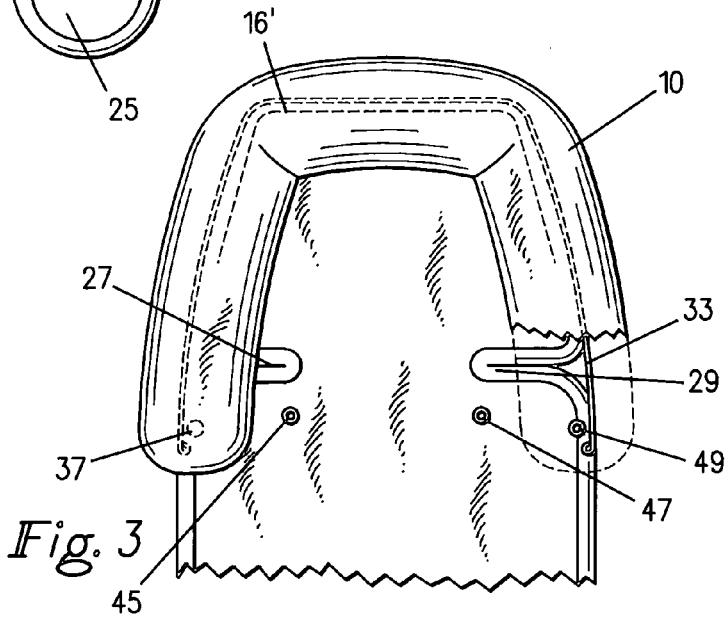
FIG. 3 is a front view with a portion of a padded support member broken away to illustrate the wire-reinforcement of the embodiment of FIG. 1.
Figure 4:
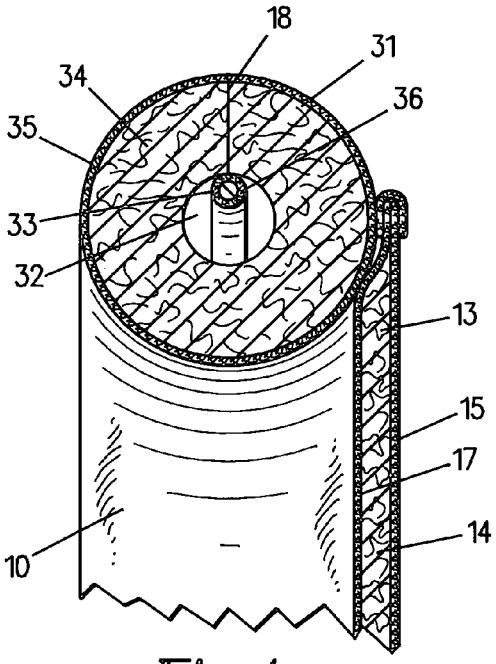
FIG. 4 is a sectional view of the embodiment of FIG. 1 taken about lines 4—4.

Referring in more detail to the drawings, as shown in FIGS. 1 through 6, the present invention is now described. In the particular embodiment shown in FIGS. 1–5, an infant head support is illustrated in which the infant support device 10 as shown in FIG. 1 is intended for use in an infant carseat, stroller, baby carriage, crib, infant support seat, changing table or any other surface where it is desirable to support an infant's head and neck. As shown in FIG. 4, the device 10 comprises a base layer 13 including a lower layer 15 and an upper layer 17 with padding 14 encased between the lower layer 15 and the upper layer 17. The lower layer 15 and the upper layer 17 are preferably made up of a cotton fabric that is washable but may also be composed of a waterproof material for easy clean-up.

The base layer 13 may be of uniform thickness terminating in a thinned, reinforced edge, or seam 21 that is uniform and extends along the entire exterior of the base layer 13 as shown in FIG. 1. The base layer 13 extends along a substantial length of an infant's body, a lower portion of the base layer 13 forming leg portions 23 and 25 which are well known in the prior art. The base layer 13 also includes two upper side notches 27 and 29 as shown in FIGS. 2 and 3 which are designed to be used in conjunction with a seatbelt harness or other safety straps in order to restrain the infant.

An upper portion of the base layer 13 includes a deformable support member 31 of inverted generally U-shaped configuration. The support member 31 is attached by seaming as at 16' along the outer, upper edge 16 of the base layer 13 as shown in dotted form in FIGS. 1, 2, 3, 5 and 6. The deformable support member 31 is designed to form a protective, conformable shell around an infant's head and is broadly made up of an outer padding or roll 34 and a bendable wire 33 which is composed of a malleable plastic or metal capable of being manually bent or deformed, as shown in FIG. 2. The bendable wire 33 is covered in a fabric or paper sleeve 36 and extends a substantial length through a central opening or bore 32 so as to be centered within the padding 34 which is generally circular in cross-section.

The padding 34 is surrounded by a covering layer 35 of the same type of material as described previously for the lower and upper layers, 15 and 17, respectively. This is shown in FIG. 4. The padding 34 and covering layer 35 completely surround the bendable wire 33 to protect and support an infant's head. The padding 34 may be a foam or cotton padding or other similar material that covers the bendable wire 33 while still providing sufficient cushioning for the infant's head; and the padding 34 may be formed with a rolled sheet of padding having ends joined together at seam 18 to form a circular wall with the bore 32. The bendable wire 33 serves to retain the padding 34 in a generally upright position on the base layer 13 as well as to enable bending of sides 12 including a pair of distal or terminal ends 41 into different configurations to closely conform to the size and shape of the infant's head and neck. As shown in FIG. 1, the deformable support member 31 has a closed end 11 and the opposite sides 12 which are slightly curved with the aid of the bendable wire 13 to conform to the shape of an infant's head. Lower ends of the sides 12 are also slightly curved or arcuate and terminate in the terminal ends 41.

Snap connectors 37 and 39 are attached on the undersides near the distal ends 41 of the support member 31 in facing relation to complementary or potential mating connectors 43, 45, 47 and 49 which are attached to opposite sides of the base layer 13, as shown in FIGS. 1, 2 and 3. The connectors 37 and 39 may be fastened to mating connectors 43 and 49, as shown in FIG. 3, forming a broad U-shaped opening, typically for a larger infant's head. The distal ends 41 are directed downwardly in this configuration, forming a cushioned but firm head support for an infant. Alternatively, the connectors 37 and 39 may be fastened to the mating connectors 45 and 47 to cause the support member 31 to form a narrow U-shaped opening with the terminal ends 41 being directed downwardly and inwardly, as shown in FIGS. 1 and 2. The inner pair of connectors 45 and 47 is offset in a lengthwise or upward direction from the outer pair of connectors 43 and 49. When the snap connectors 37 and 39 are fastened to the inner mating connectors 45 and 47, the position of the connectors 45 and 47 forces the terminal ends 41 of the support member 31 to be directed downwardly and slightly inwardly. Typically, a premature or small infant requires additional head and neck support which is provided with the inwardly angled or convergent terminal ends 41 of FIG. 1. The inwardly convergent terminal ends 41 provide added support to the neck of a small infant thereby preventing lateral movement of the head while also aiding in preventing the infant from slouching or sliding forward.

The connectors 37 and 39 may also remain in the unfastened position wherein the support member 31 serves as a sole means of support for the infant's head. This form of invention would typically be utilized with a larger infant that does not require neck support.

Figure 5:
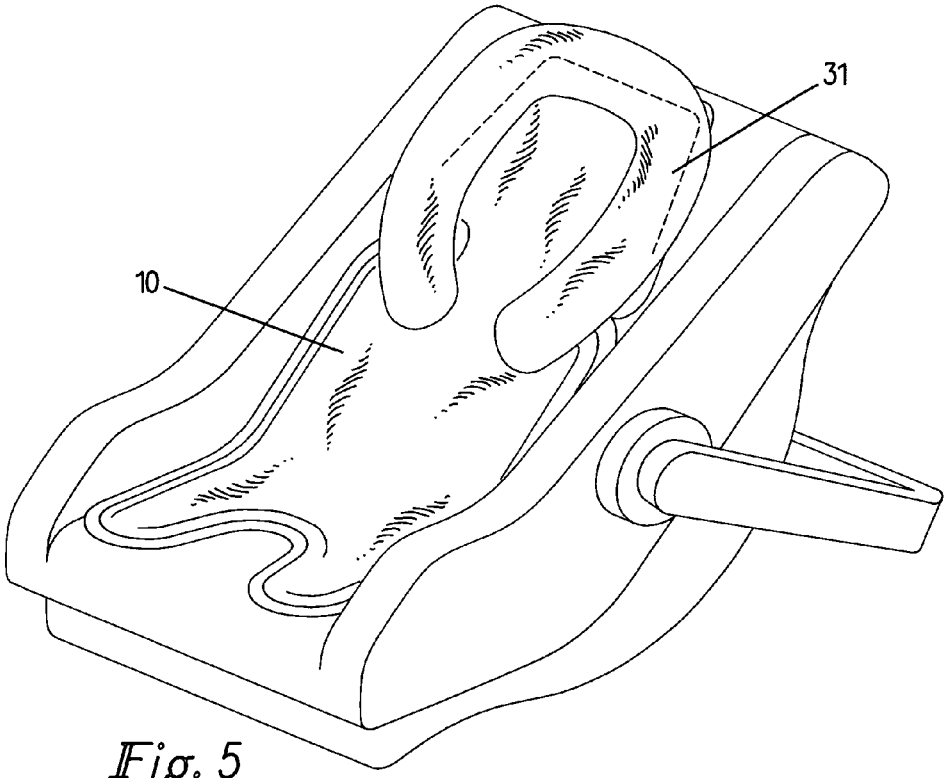
FIG. 5 is a perspective view of the embodiment of FIG. 1.

As shown in FIG. 5, the support pad 10 may be placed in an infant carseat to provide a firm but flexible means of support around an infant's head and neck, thereby preventing lateral movement of the infant's head and preventing the infant's head from tipping forward while in a carseat, stroller or the like. Once the support pad 10 is configured in a particular shape, it will remain in that configuration until reformed. Further, the support pad 10 may be placed on a flat surface with the deformable support member 31 providing a means for stabilizing an infant on its back while changing or dressing an infant.

Figure 6:
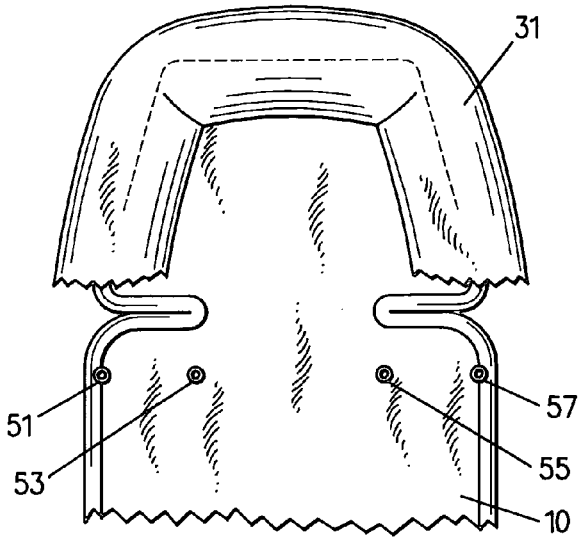
FIG. 6 is a fragmentary front view of an alternate embodiment.

Another embodiment of the present invention is shown in FIG. 6 wherein the mating connectors 51, 53, 55 and 57 are aligned along a common plane transversely to the length of the pad 10 and are designed to be fastened to the connectors 37, 39 to once again provide a rigid form of support for an infant. This configuration results in the terminal ends 41 facing downwardly and slightly inwardly.

In use, an infant may be placed on the support pad 10, the head of the infant placed within the support member 31 with the support member being adjusted to snugly fit around an infant's head, and the closed ends 41 are fastened using connectors 37 and 39 and their mating connectors in the outer position 43 and 49 or the inner position 45 and 47, depending upon the size of the infant.

It is therefore to be understood that while preferred forms of invention are herein set forth and described, the above and other modifications may be made therein without departing from the spirit and scope of the invention as defined by the appended claims and reasonable equivalents thereof.

We claim:

1. An infant support pad comprising:

a padded base layer adapted to extend along a substantial length of an infant's body;

a head support member at one end of said base layer, said head support member including an outer padding member in surrounding relation to an inner bendable reinforcing member, said head support member adapted to be releasably superimposed on said base layer with the aid of inner and outer separable fastener means, located such that when the outer fastener means connect the head support to the base layer, a broader U-shaped opening is provided, and when the inner fastener means connect the head support to the base layer, a narrower U-shaped opening is provided, with the narrower U-shaped opening, said support member shaped to engage an infant's head and neck and terminating in a pair of downwardly projecting sides and convergent terminal ends.

2. The infant support pad according to claim 1 wherein said reinforcing member includes a bendable wire substantially centered within said outer padding member.

3. The infant support pad according to claim 2 wherein said bendable wire extends along a substantial length of said head support member.

4. The infant support pad according to claim 3 wherein said bendable wire is a wire rod of limited flexibility.

5. The infant support pad according to claim 4 wherein said wire rod is covered with a sleeve member.

6. The infant support pad according to claim 1 wherein said outer padding member comprises a circular roll having a bore centered therethrough.

7. The infant support pad according to claim 1 wherein said support member is of generally U-shaped configuration having arcuate sides and a closed end.

8. The infant support pad according to claim 7 wherein each of said sides includes fastening means for releasable attachment to said base layer whereby to adjust the space between said sides of said head support member.

9. The infant support pad according to claim 8 wherein said fastening means includes a snap connector and mating member.

10. The infant support pad according to claim 9 wherein said mating member includes a pair of mating connectors for each said snap connector.

11. The infant support pad according to claim 10 wherein each of said pair of mating connectors includes an outer connector and an inner connector.

12. The infant support pad according to claim 11 wherein said inner connector is offset in an upward direction from said outer connector.

13. The infant support according to claim 11 wherein said inner connector and said outer connector are transversely aligned in a common imaginary plane with respect to one another.

14. An infant support pad comprising:

a padded base layer adapted to extend along a substantial length of an infant's body;

a cushioned member of inverted generally U-shaped configuration attached at one end of said base layer including a bendable member substantially centered therein;

The cushioned member adapted to be releasably fastened to the base layer with the aid of inner and outer separable fastener means located such that when the outer fastener means connect the cushioned member to the base layer, a broader U-shaped opening is provided, and when the inner fastener mean connect the head support to the base layer, a narrower U-shaped opening is provided, with opposite lower sides of the cushioned member projecting downwardly and the distal ends of the cushioned member converging inwardly, lower ends that project downwardly and converge inwardly to form a self-supporting head support.

15. The infant support pad according to claim 14 wherein said cushioned member comprises an arcuate closed end and a pair of arcuate sides terminating in said distal ends.

16. The infant support pad according to claim 14 wherein said fastener means comprise snap connectors on said distal ends and complementary mating connectors on upper midpoint of said base layer.

17. The infant support pad according to claim 16 wherein said mating connectors on said upper midpoint of said base layer include an outer connector and an inner connector corresponding to each of said snap connectors.

18. The infant support pad according to claim 17 wherein said inner connector is offset in an upward direction from said outer connector.

* * * * *